United States Patent [19]

Ciolkevich

[11] 4,266,109

[45] May 5, 1981

[54] FLOATING VALVE SEAT INDUCTOR

[75] Inventor: John T. Ciolkevich, Richfield, Ohio

[73] Assignee: Park-Ohio Industries, Inc., Cleveland, Ohio

[21] Appl. No.: 113,586

[22] Filed: Jan. 21, 1980

[51] Int. Cl.[3] ..... H05B 5/00

[52] U.S. Cl. ..... 219/10.57; 219/10.43; 219/10.71; 226/129

[58] Field of Search ..... 219/10.43, 10.57, 10.71, 219/10.79; 266/129

[56] References Cited

U.S. PATENT DOCUMENTS

| | | | |
|---|---|---|---|
| Re. 29,046 | 11/1976 | Del Paggio | 219/10.57 |
| 2,797,289 | 6/1957 | Georgen | 219/10.57 |

*Primary Examiner*—Volodymyr Y. Mayewsky
*Attorney, Agent, or Firm*—Meyer, Tilberry & Body

[57] ABSTRACT

A floating inductor assembly for use in heating a generally conical valve seat formed concentrically around a central bore in an engine component, wherein the assembly is adapted to be moved toward and away from the valve seat by a selectively movable element. This floating inductor assembly comprises a carrier, an inductor having a shape generally matching the valve seat and mounted on the carrier, an aligning nose member extending from the carrier in a given direction and generally concentric with the inductor, and first and second flange portions supported on the carrier and extending radially outwardly in a direction perpendicular to the given direction of the nose member, whereby each flange portion is adapted to engage a coupling member for supporting the assembly onto the movable element in a manner to allow floating in the radial direction only.

13 Claims, 10 Drawing Figures

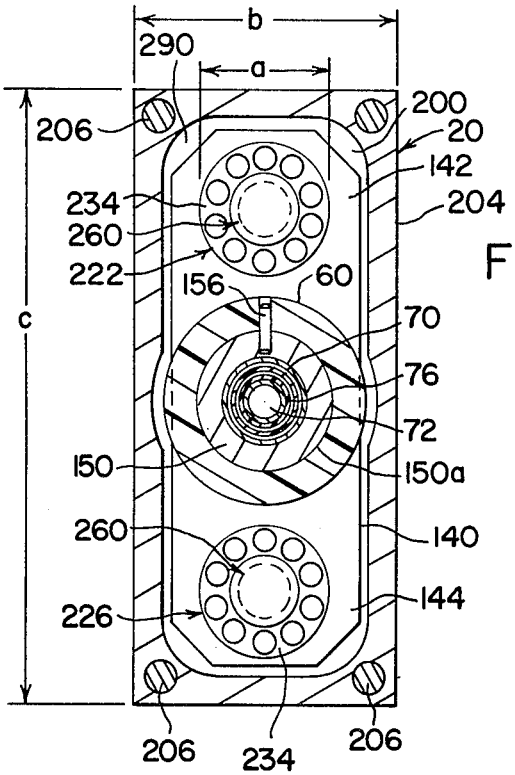
FIG. 4
b = 4.4cm
c = 10.2cm
b ≲ 7.5cm
FIG. 5
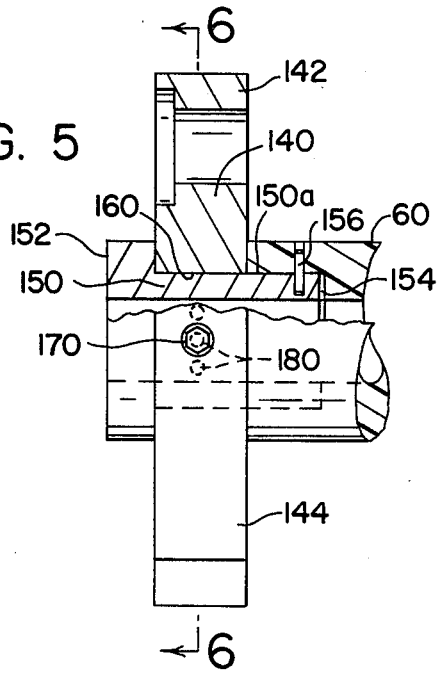
FIG. 6
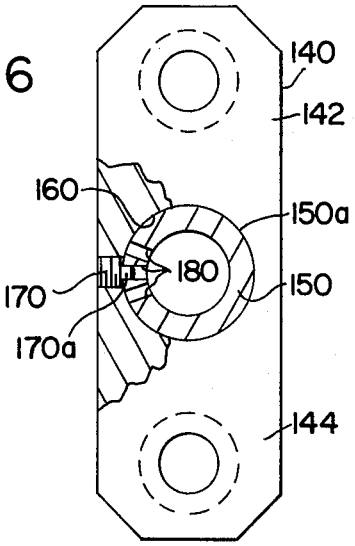

FLOATING VALVE SEAT INDUCTOR

This invention relates to the art of inductively heating valve seats and more particularly to a floating valve seat inductor assembly to be used in inductively heating valve seats.

INCORPORATION BY REFERENCE

A floating valve seat inductor of the general type to which the present invention is directed is disclosed and claimed in prior U.S. Pat. No. Re. 29,046. This patent is incorporated by reference herein.

BACKGROUND OF THE INVENTION

With the advent of low lead gasoline, it is now common practice to provide hardened valve seats in internal combustion engines. In this manner, the valve seats have a better wear characteristic and can withstand the constant pounding by a poppet valve. This is needed because the lubricating effect of lead and phosphorous in the gasoline being consumed is no longer available. Several concepts have been used in providing such hardened valve seats. One of these is to utilize hardened inserts to define the valve seats themselves. Of course, this solution presents obvious difficulties in that the valve seats are more expensive and require substantially more manufacturing and assembling costs. The most common approach is to inductively heat the conical surface forming the valve seat of an internal combustion engine by positioning an inductor adjacent the seat and directing high frequency currents through the inductor. After the inductor has been energized to heat the valve seats inductively, the heating operation is discontinued. At that time, the valve seat is quenched, generally by mass quenching which results from conduction of heat from the valve seat rapidly into the surrounding metal. In high production, it is desirable to heat all valve seats at the same time for subsequent quench hardening by liquid or mass cooling.

U.S. Pat. No. Re. 29,046 illustrates a machine for inductively heating several valve seats simultaneously. In accordance with the teachings of this prior patent, incorporated by reference herein, a plurality of floating inductor assemblies are provided in a plurality of housings which are movable toward and away from respective valve seats of an engine component. Each of the inductor assemblies includes an inductor loop at one end of a carrier and a nose concentric with the loop extending toward the valve seat. This nose contacts the valve bore in the engine component to center the respective inductor carriers with respect to the valve seat preparatory to induction heating. This action occurs when the housings carrying the respective inductor assemblies are moved toward the valve seats. By using the inductor carrier and nose which enter the bore, each of the inductor assemblies is centered with respect to the particular valve seat to be heated, irrespective of certain manufacturing tolerances between adjacent valve seats.

After the housings move the carriers into the position with the inductors concentric with the valve seats, the motion of the housing toward the valve seats continues until the inductors actually engage the valve seats. Thereafter, the various housings carrying the inductor assemblies are locked together and moved in unison away from the engine component a distance corresponding to the desired air gap for proper induction heating. In this manner, the machine compensates for axial offset of the respective valve seats being processed during a given cycle. To allow for radial alignment of the respective inductor assemblies with respect to the valve seats as the aligning noses enter the valve bore, each of the inductor assemblies floats within their respective housings in a manner to allow movement only in the radial direction. To accomplish this, a flange is provided around the inductor carrier of the inductor assembly. This flange is clamped within a companion housing to allow only radial movement. During processing of the valve seats, the inductor at the end of the inductor assembly is properly positioned in the radial direction and in the axial direction for the desired heating of the valve seats. This prior machine has been exceedingly successful and is generally used throughout the automotive industry.

As the engines being used in automobiles are reduced in size, the spacing between adjacent valve seats to be hardened has been reduced. Consequently, the prior housings carrying the floating inductor assemblies were too large to allow the desired small spacing between the adjacent inductors. This problem was solved in one of two ways. Either the engine component was processed twice so that only alternate valve seats were hardened during a heating cycle or the floating inductor assemblies were machined so that the inductor and nose were offset from the primary axis of the total floating inductor assembly. Each of these solutions had disadvantages. If the engine component required two cycles for processing its valve seats, the production rate was substantially reduced. If offset inductor assemblies were provided, it was necessary to provide different structures for the inductor assemblies used at adjacent valve seats. Consequently, at least twos designs had to be manufactured and stockpiled. Also, even with the offset inductors, it was not always possible to simultaneously process the valve seats of the head of a relatively small engine.

INVENTION

The present invention relates to an improvement in the floating inductor assembly of the type shown in prior U.S. Pat. No. Re. 29,046, which invention overcomes the disadvantages experienced when the valve seats to be inductively heated for subsequent quenching are relatively close together.

In accordance with the present invention, the floating inductor assembly of the type described above is provided with an elongated flange having two spaced flange portions, each of which is clamped in the movable member. This movable member forms a housing for the floating inductor assembly. By providing coupling structures at the two ends of the elongated flange, the inductor assembly can float in a radial direction as the housing or movable element is moved with the nose member of the inductor assembly entering the bore for centering the assembly with respect to the valve seat to be heated. By providing the elongated flange or equivalent structure and two spaced coupling members on opposite sides of the inductor assembly, the surrounding housing for the inductor assembly can be generally rectangular in cross-section with a dimension in the lateral direction substantially less than the dimension in the vertical direction. Thus, two such housings can be closely spaced with respect to each other in a transverse direction. This allows use of the concept of a floating valve seat inductor assembly when the valve seats are closely spaced. The housing for the inductor assembly has an internal cavity which is larger than the flange in all directions so that the flange can move within the housing in any direction radially of the inductor.

In accordance with another aspect of the present invention, the valve seat inductor assembly is provided with an arrangement for adjusting the angular position of its elongated flange with respect to the inductor loop located at the end of the assembly. As is well known, the inductor loop includes a circumferentially located gap which allows current to flow in a path around the loop. This gap should not be opposite to an area of the valve seat adjacent a high mass portion of the engine component. Thus, there is provided in accordance with an aspect of the invention, a structure for adjusting the angular position of the gap forming the inductor loop. By providing an elongated housing with the separating gap of the loop at one side, adjacent housings can be reversed in a vertical or elongated sense. Consequently, the needed gap can be located on either transverse side of the supporting housing according to which flange portion is extended upwardly. This ability to shift the gap from one side of the assembly to the other by reversing the assembly position together with the ability to adjust slightly the specific angular position of the gap gives wide latitude in positioning the gap or space in the loop with respect to the circumference of a valve seat being hardened.

In accordance with the present invention, there is provided a novel floating inductor assembly as previously described which floating inductor assembly includes an arrangement for adjusting the position of the input gap in the inductor loop with respect to the housing which carries the inductor assembly. In addition, the present invention relates to an improvement in the combination of the floating inductor assembly and housing for supporting the same in a machine, wherein the housing is moved toward the valve seat into a heating position and away from the valve seat into a loading position. In accordance with this improvement, the mounting means between the assembly and the housing includes first and second flange portions supported on the inductor assembly carrier. These flange portions extend radially outwardly in a direction generally perpendicular to the axis of movement of the housing toward and away from the valve seat. In accordance with this improvement, there is provided a first coupling means for coupling the first flange portion onto the movable housing and a second coupling means for coupling the second flange portion onto the movable housing. These first and second coupling means are generally in diametrically opposed relationship with respect to the moving axis of the housing and the inductor assembly carried thereby. Radial movement of the floating inductor assembly with respect to its housing is accomplished by including an arrangement in the coupling means for allowing only radial movement of the flange portions with respect to the housing. In this manner, the housing may have a lateral dimension substantially less than the vertical dimension when the two spaced coupling means are vertically aligned on opposite sides of the inductor carrier. Consequently, the housings are relatively narrow in a vertical direction with the two spaced coupling means allowing radial displacement being vertically above and vertically below the moving axis for the assembly. Adjacent housings can thus be close together without requiring geometrical shapes for each of two closely adjacent housings. Consequently, even though the valve seats are closely spaced with respect to each other, all valve seats can be inductively heated in a single cycle by using the present invention and without using a special configuration for each of the two closely adjacent assemblies.

The primary object of the present invention is the provision of a floating inductor assembly for use in inductively heating valve seats, preparatory to quench hardening the seats, which inductor assembly has a radial guiding means that reduces the required transverse dimension of the unit or housing carrying the inductor assembly.

Another object of the present invention is the provision of a floating inductor assembly, as defined above, which assembly allows the use of a pair of floating assemblies in closely spaced transverse relationship to inductively heat adjacent valve seats simultaneously.

Still a further object of the present invention is the provision of a floating inductor assembly, as defined above, which assembly allows simultaneous heating of adjacent valve seats in engine components for use with relatively small engines wherein the spacing between the valve seats is relatively small.

Another object of the present invention is the provision of a floating inductor assembly, as defined above, which assembly allows easy coupling with a supporting housing used to move the assembly into and from the heating position.

A further object of the invention is the provision of a floating inductor assembly movable by a housing or other support element toward and away from a valve seat, which inductor assembly includes an inductor loop generally concentric to both the valve seat and the body of the assembly and which can be used for any of several different valve seats in an engine component.

Yet another object of the present invention is the provision of the combination of a floating inductor assembly and a housing therefor, which combination has a relatively small transverse dimension when compared to the vertical dimension. These dimensions are controlled by the geometry of the coupling structure used to couple the inductor assembly in a radial floating manner on the movable housing.

Still a further object and advantage of the present invention will become apparent from the following description, taken together with the accompanying drawings.

BRIEF DESCRIPTION OF THE DRAWINGS

FIG. 4 is a cross-sectional view taken generally along line 4—4 of FIG. 3;

FIGS. 5 and 6 illustrate another aspect of the present invention including a structure for adjusting the angular position of the supporting flange onto the inductor assembly; and, FIGS. 7 and 8 are schematic partial views showing the relationship between the input gap of a heating inductor and the flange utilizing the concept illustrated in FIGS. 5 and 6.

PREFERRED EMBODIMENT

Figure 1:
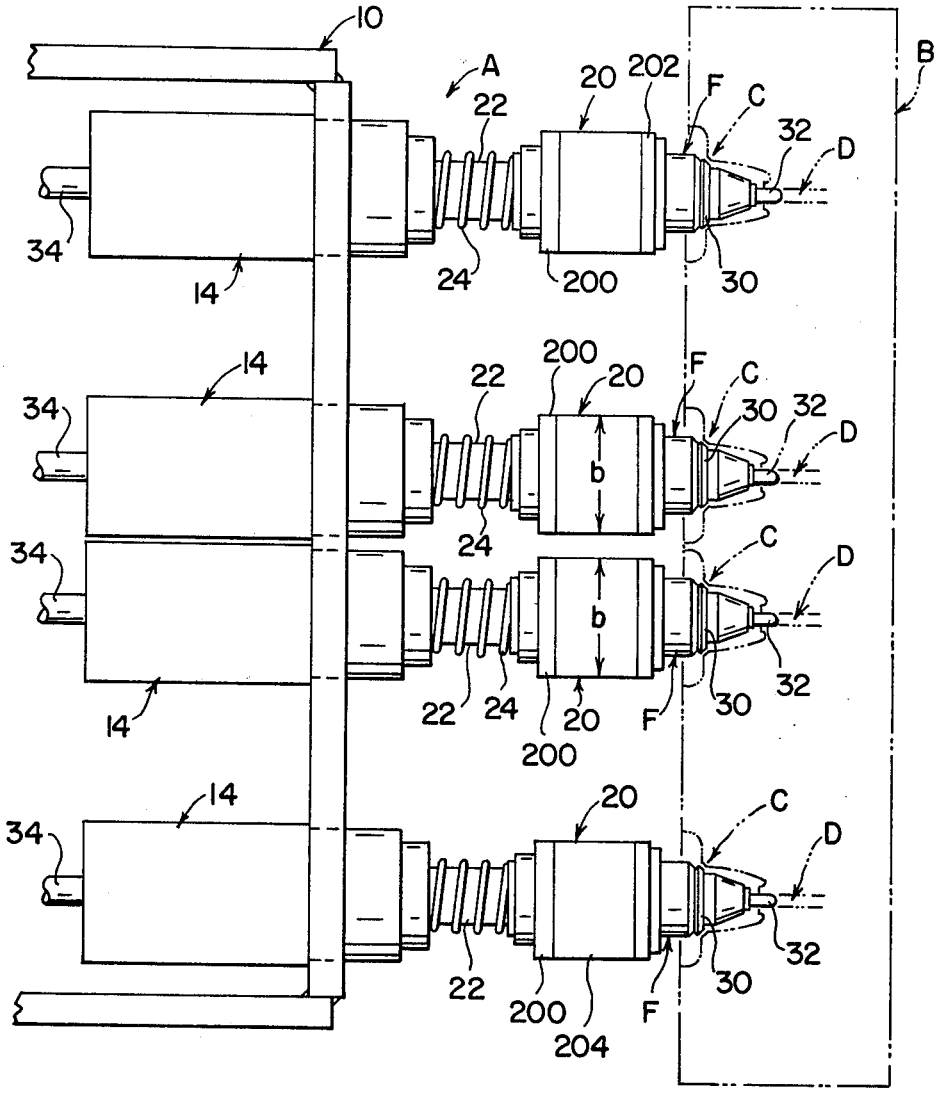
FIG. 1 is a schematic top elevational view illustrating the general environment of the present invention when applied to a machine for inductively heating a series of spaced valve seats in an engine component.
Figure 2A:
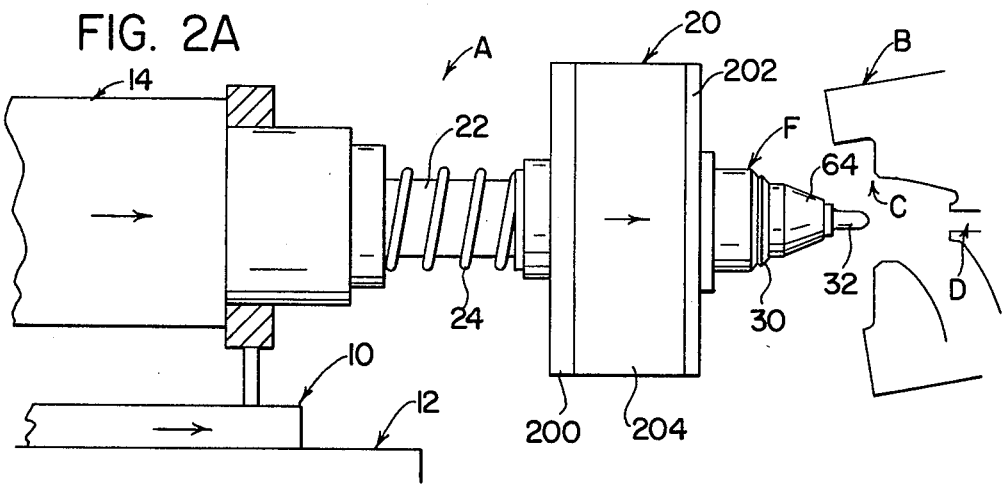
FIGS. 2A, 2B and 2C are enlarged side elevational views showing somewhat schematically the structure illustrated in FIG. 1 in three operative positions.

Referring now to the figures wherein the showings are for the purpose of illustrating a preferred embodiment only and not for the purpose of limiting same, FIGS. 1 and 2 show a machine or apparatus A which coacts with an engine component B supported opposite thereto for inductively heating the generally conical valve seats C of the engine component. In accordance with standard practice, each of the valve seats has a concentric bore D into which the stem of a poppet valve fits during operation of the engine. Since the present invention relates to an improvement in the apparatus described in U.S. Pat. No. Re. 29,046, which patent is incorporated by reference herein, machine or apparatus A will be described only briefly. This apparatus includes a frame 10 movable on a base 12 and adapted to carry a plurality of locking and journal blocks 14 so that the blocks move in unison with frame 10 as it is reciprocated between the heating and loading positions. Extending outwardly from each block 14 there is provided a housing or movable element 20 supported onto a tube 22 which is slidably received within a block 14. The block includes a locking arrangement for locking tubes 22 with respect to blocks 14 and, thus, frame 10 when desired. Around each tube 22 there is provided a coil spring 24 which bias housings 20 outwardly from blocks 14 toward engine component B. In accordance with known practice, the amount of outward movement of housing 20 is restricted by structure within the blocks 14 which is not shown. The locking arrangement within the blocks is not shown since it does not form a part of the present invention and is clearly illustrated in the prior U.S. Pat. No. Re. 29,046. Within each housing 20 there is a floating inductor assembly F having an outwardly facing inductor loop 30 with an outwardly extending centering nose member 32. Extending in the opposite direction are tubular inlet leads 34 which will be described in more detail and which are also shown in the prior United States Letters Patent. Inductor loop 30 is adapted to be energized when adjacent a valve seat C for the purpose of inductively heating the valve seat. After inductor loop 30 is de-energized, the mass surrounding the valve seat quenches the valve seat to harden the conical surface thereof. This increases the wear characteristics of the valve seat.

Figure 2B:
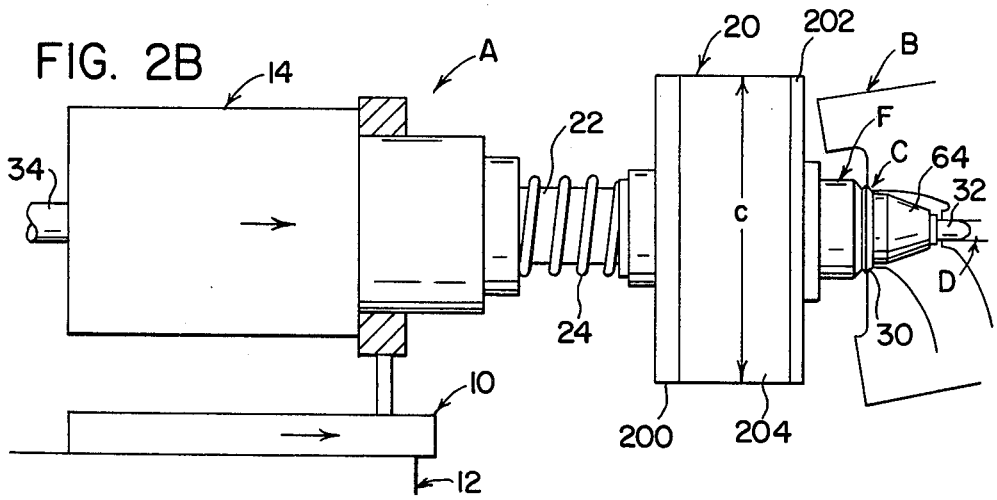
Figure 2C:
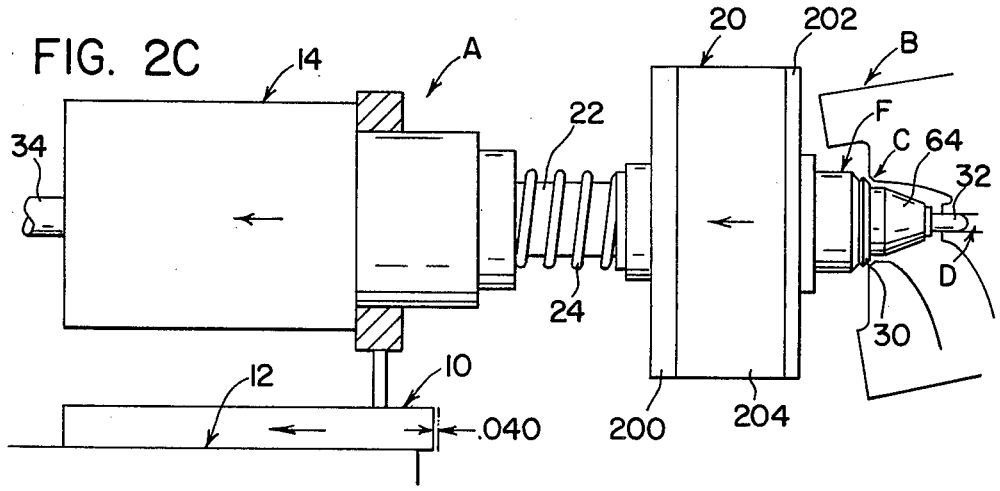

In operation, housings 20 are aligned with respective valve seats C of engine component B, as shown in FIG. 1. Frame 10 is moved into a retracted position, generally shown in FIG. 2A, and springs 24 force housings 20 in a forward or extended direction to a position which will allow loading of an engine component B in front of machine A. Thereafter, as shown in FIG. 2B, frame 10 is moved toward engine component B. This moves all of the locking and journal blocks 14 carrying housings 20 which are reciprocally mounted on the blocks. When nose 32 engages bore D, inductor loop 30 is centered with respect to valve seat C. After this centering action, which generally involves slight radial shifting of assembly F and is shown in FIG. 2B, is accomplished, frame 10 moves further in the forward direction until all of the inductor loops engage their respective valve seats. This is also shown in FIG. 2B. Thus, irrespective of the axial displacement of adjacent valve seats, springs 24 allow proper positioning of the inductor loops in contact with the respective valve seats. In this position, locking blocks 14 lock all tubes 22 with respect to the blocks and, thus, with respect to common frame 10. Thereafter, frame 10 is retracted, as shown in FIG. 2C, a distance corresponding to the desired air gap between the inductor loops and the valve seats. Consequently, all inductor loops are moved away from the valve seats a distance necessary to provide a desired, preselected air gap. This gap is illustrated as 0.040 inches in FIG. 2C. In this slightly retracted, intermediate position, all inductor loops are energized for inductively heating the valve seats. Thereafter, the inductor loops are de-energized for quenching of the valve seats. The heating time, frequency and power level determine the amount and depth of heating. Following heating, frame 10 is retracted on base 12 to a loading position and the supporting tubes 22 are released for again projecting housings 20 into a forward position for subsequent operation as described. As can be seen, the floating inductor assemblies F must move radially to compensate for any radial misalignment between the centered position of assembly F and the actual position of a valve seat to be hardened. In practice, bore D and valve seat C are machined in a fixed relationship and generally in unison; therefore, by engaging bore D and shifting inductor assembly F with respect to this bore, loop 30, which is concentric with nose 32, is moved into a concentric position with respect to seat C. The present invention relates to an improvement in a mechanism for mounting assembly F in housing 20 and for allowing this radial movement of floating inductor assembly F with respect to the housing. A device constructed in accordance with the invention does not require a substantial transverse dimension for housing 20. The transverse dimension means a dimension in a direction extending between the valve seats as shown in FIG. 1.

Figure 3:
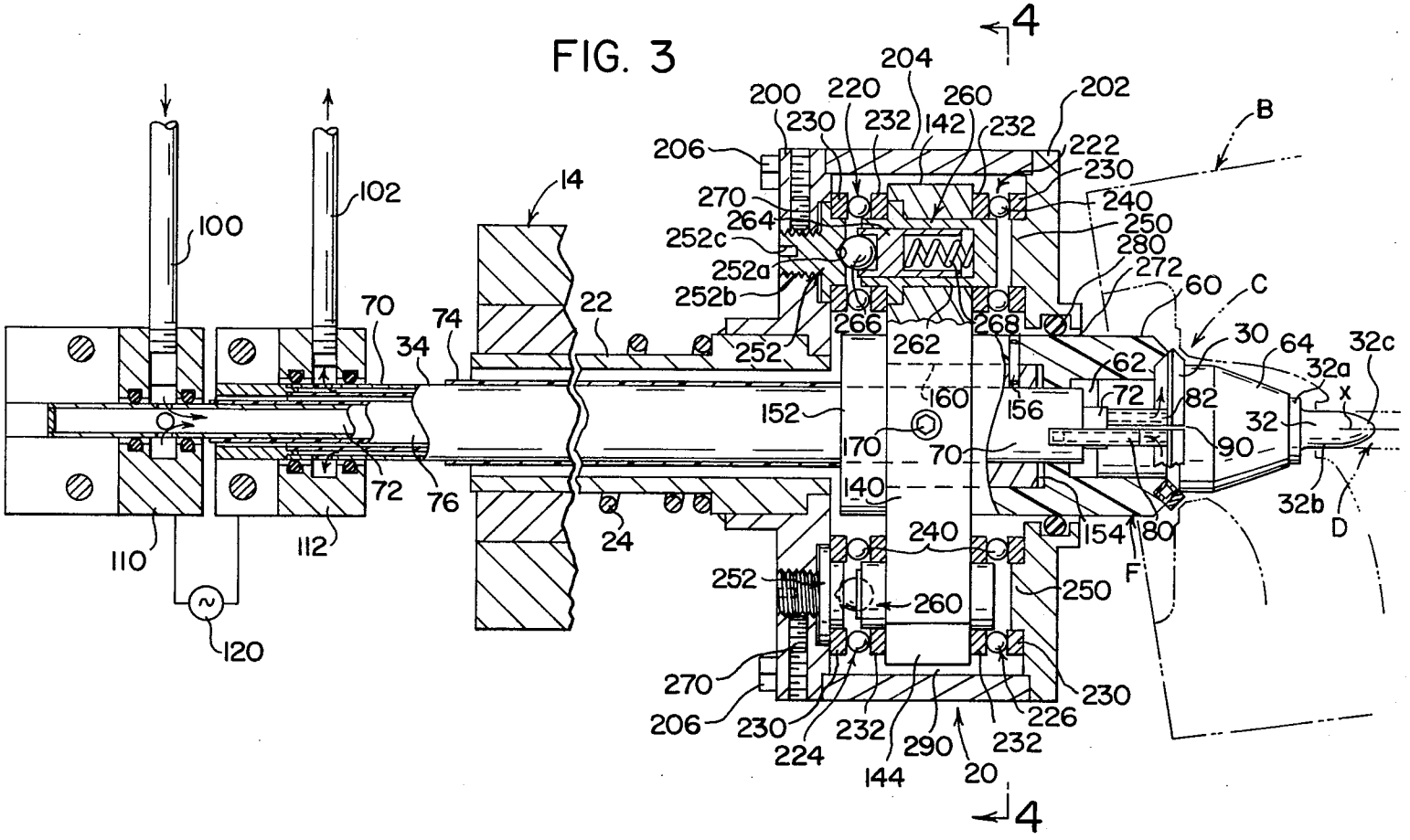
FIG. 3 is an enlarged cross-sectional view showing certain details of the preferred embodiment of the present invention and the manner in which it is connected to the apparatus or machine schematically illustrated in FIG. 1.

In accordance with the present invention there is provided an improvement in the structure of the floating inductor assembly F. Since all of these assemblies are identical, only one assembly will be described in detail and this description will apply equally to all inductor assemblies F. Referring now to FIG. 3, a carrier 60 machined from an insulating material includes a forwardly facing recess 62 into which is adhesively secured a plug 64 also formed from an insulation material. Inductor loop 30 is a hollow conductor and is held between plug 64 and carrier 60. Carrier 60 includes an outwardly facing conical portion onto the end of which is mounted the previously discussed centering nose member 32. This member has an enlarged support shoulder **32*a* abutting the end of plug 64, a cylindrical body portion 32*b*, which is concentric with axis x, and a tapered point 32*c* which allows insertion of nose member 32 into bore D. The tubular inlet leads 34 are formed as hollow tubes 70 and 72, each of which forms an electrical connection for loop 30. An outer insulator sleeve 74 is provided on tube 70 and insulation sleeve 76 is provided between tubes 70, 72. Tubes 70, 72 are connected to leads 80, 82, respectively, at an input gap 90 of generally circular loop 30. Coolant lines 100, 102 direct coolant through tubes 70, 72 and leads 80, 82 for circulation of a coolant through loop 30. Electrical connections 110, 112 are connected across an appropriate power supply and are connected electrically to tubes 70, 72 for completing the electrical circuit through loop 30. Thus, when energizing connections 110, 112 alternating current is directed through loop 30**. This alternating current, in practice, is radio frequency and has a power level to provide the desired heating temperature and pattern in a valve seat.

Onto carrier 60 there is secured a rectangular flange 140 having diametrically opposed flange portions 142, 144 extending radially outwardly from axis x. To fix the flange onto the carrier there is provided a coupling arrangement, best shown in FIGS. 5 and 6. In this structure, a sleeve 150 has a stop shoulder 152 and an outwardly facing cylindrical surface 150*a* defining a protrusion which enters into a recess 154 of carrier 60. During assembly, a pin 156 is forced through an opening in the outer surface of carrier 60 and into a bore within the metal sleeve 150. This pin locks sleeve 150 onto carrier 60 into a position where it can be assembled by an adhesive. Flange 140 includes a central cylindrical bore 160 surrounding surface 152*a* and fixedly held to sleeve 150 by a set screw 170 having an inwardly directed pin 170*a*. This pin is adapted to enter one of several angularly spaced bores 180 in sleeve 150. Any number of bores could be provided; however, three bores are illustrated. In this manner, the relative position of the flange portions 142, 144 with respect to loop 30 can be adjusted slightly for a purpose to be explained in more detail with respect to FIGS. 7 and 8. Rectangular flange 140 is assembled onto and becomes a part of the floating inductor assembly F by the structure so far explained.

Rectangular flange 140 is supported within housing 20 by spaced rectangular plates 200, 202 between which extends a rectangular wall 204. Peripheral bolts 206 clamp plates 200, 202 together to capture flange portions 142, 144 within housing 20. As previously mentioned, the coupling between housing 20 and floating inductor assembly F allows only radial movement between these two assembled components. To accomplish this, thrust units 220, 222, 224 and 226 are provided which firmly grip flange portions 142, 144 in a manner to allow only radial displacement of the total inductor assembly F with respect to the housing 20, which housing is reciprocated to and from the valve seat as previously described. Connections 100, 102 and 110, 112, as shown in FIG. 3, are movable slightly to allow for this radial displacement of the floating inductor assembly with respect to the housing 20, which housing is fixed in block 14 in a radial direction with respect to axis x of assembly F. Thrust units 220, 222, 224, 226 are formed in pairs and are located at the diametrically opposed flange portions 142, 144 to define a relatively small transverse distance which is used for controlling the radial movement of assembly F. Each of the thrust units includes spaced rings 230, 232 which define facing flat surfaces between which are located a circular array of ball bearings 240. These bearings are held together by an appropriate ball retainer 234, shown in FIG. 4. The clamping action between plates 200, 202 exerts thrust between rings 230, 232, the former of which is supported on a rectangular plate and the latter of which is fixed onto flange 140, as best shown in FIGS. 3 and 4. In this manner, movement of the flange can take place in a radial direction as determined by the force exerted on nose 32 as it enters bore D during movement of frame 10 in the direction shown in FIG. 2B. Sufficient clamping pressure is exerted onto the thrust units to prevent tilting of flange 140 during centering of loop 30 with respect to valve seat C. To support rings 230 of units 222, 226, there are provided circular bosses 250. A cam insert 252 supports the other two rings 230 and also provides a generally conical cam recess 252*a* into which a cam follower assembly 260 is forced to center both flange portions 142 and 144 with respect to housing 20. A variety of cam followers could be provided; however, cam follower assembly 260 includes an outer cylindrical surface to locate rings 232 onto flange 140. This function is provided by a hollow retainer 262 extending in opposite directions from flange 140 and adapted to receive an internal plunger 264 having a ball follower 266 which is forced toward cam recess 252*a* by an appropriate spring 268. For the purpose of compensating for tolerances and for adjusting the position of inductor 30 in an axial direction, insert 252 has a threaded shank 252*b* received in plate 200. Set screw 270 locks the insert in a position adjusted by an Allen wrench in recess 252*c*. A clearance opening 272 is provided at the forward end of housing 20 to allow slight radial movement of inductor assembly F during the centering action. An appropriate O-ring seal 280 is provided around the clearance opening to prevent ingress of deleterious material into the interior of housing or movable element 20.

As can be seen, the use of a rectangular flange 140 allows the use of relatively small, standard ball bearing rings for thrust elements in the assembly. Also any adjustment of pressure can be done by using adjustable inserts 252. Housing 20 includes an internal generally rectangular cavity 290, best shown in FIG. 4. The periphery of this cavity is only slightly larger than the periphery of flange 140 to allow slight radial movement of the flange within the housing.

Referring now more particularly to FIG. 4, it is noted that the use of diametrically opposed flange portions 142, 144 allows support of floating inductor assembly F without requiring a relatively large transverse dimension b for housing 20. This dimension is dictated primarily by the transverse width a of the thrust units 222–226 and the width of flange portions 142, 144 needed to coact with these units. This dimension a is substantially less than the vertical height c of housing 20. In practice, the thickness or transverse dimension b is less than 7.5 cm when the height of housing 20 is greater than 10 cm. The clearance in cavity 290 for flange 140 is such that balls 240 stay on their supporting rings and the cam and followers on portions 142, 144 remain in active engagement. This dimension is selected to accommodate the largest axial misalignment of a valve seat with an assembly F.

Figure 7:
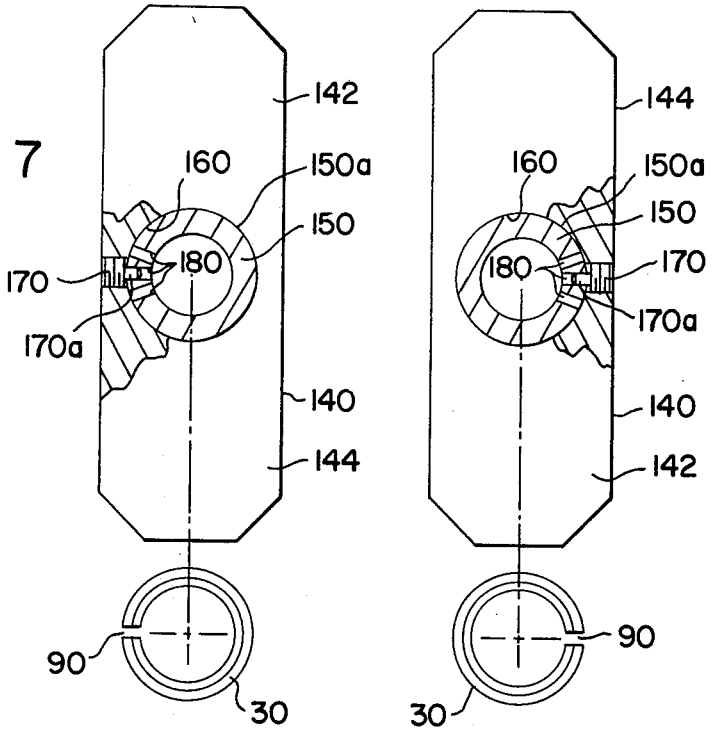
Figure 8:
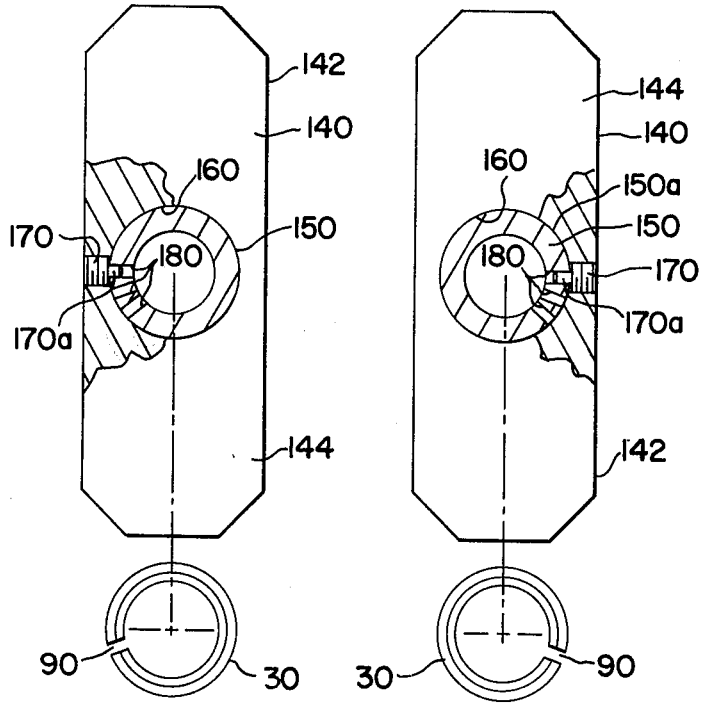

By providing the support arrangements in the vertical position and not in the transverse position, a relatively narrow housing can be provided. This then allows two housings to be moved close together as shown in FIG. 1 to accommodate closely spaced valve sea's in an engine component B. Also, only one design is necessary. It is not required that two floating inductor assemblies be provided, one for a right hand valve seat and the other for an adjacent left hand valve seat in a pair of seats. As shown in FIGS. 7 and 8, adjacent valve seats can be processed by reversing the position of the flange portions 142, 144. In this manner, the gaps 90 of inductor loops 30, which are on a side of assembly F, face in opposite directions, which relationship is desired in inductively heating two adjacent valve seats in a pair. By providing the set screw 170 and companion angularly disposed bores 180, gaps 90 can be adjusted slightly with respect to the vertical position of flange 140. In this manner, the gaps can be moved to desired circumferential positions in a valve seat being heated during set up of the machine A. By providing the gap 90 on the side of an assembly F, a right and left heating unit can be created only by inverting assembly F in its housing 20. Thereafter, slight angular adjustments can be made by turning flange 140 on carrier 60.

In practice 202 and wall 204 are formed as a unit.

Having thus described the invention, it is claimed:

1. In an apparatus for inductively heating a generally conical valve seat formed concentrically around a central bore in an engine component, said apparatus including a selectively movable element adapted to be moved along an axis between an extended heating position and a retracted loading position and an inductor assembly, said inductor assembly including a carrier, an inductor having a shape generally matching said seat and mounted onto said carrier, an aligning nose member extending from said carrier parallel to said axis and generally concentric with said inductor, means for supporting said inductor assembly on said movable element, said mounting means including means for allowing only radial movement of said carrier with respect to said movable element when said nose member enters into said bore during movement of said element into said heating position with said inductor in heating relationship with said seat and centering means for biasing said carrier into a preselected radial position, the improvement comprising: said mounting means including first and second flange portions supported on said carrier and extending radially outwardly in a direction generally perpendicular to said axis, first coupling means for coupling said first flange portion onto said movable element, second coupling means for coupling said second flange portion onto said movable element, said first and second coupling means being generally diametrically opposed with respect to said axis, said radial movement allowing means including means in said coupling means for allowing only radial movement of said flange portions with respect to said movable element, said movable element having a first dimension in a first direction transverse to both of said coupling means and a second dimension in a second direction generally orthogonal to said first direction and extending between said coupling means, said first dimension being substantially less than said second dimension; and said centering means includes a centering structure at each of said flange portions.

2. The improvement as defined in claim 1 wherein each of said coupling means includes first and second thrust units one on each axial side of one of said flange portions and means on said movable element for clamping said one flange portion between said thrust units, each of said thrust units including intermediate ball bearings to allow radial deflection only of said thrust units.

3. The improvement as defined in claim 2 wherein said thrust units each include a first member secured to said flange portion and engaging said ball bearings and a second member secured to said movable element and engaging said ball bearings.

4. The improvement as defined in claim 3 wherein said first and second members are generally flat rings.

5. The improvement as defined in claim 4 wherein said centering structure includes a cam follower supported on a flange portion in the center of one of said first members and a cam element on said movable element and within one of said second members.

6. The improvement as defined in claim 5 wherein said inductor is a loop with an input gap and said flange portions are part of a flange and including means for adjusting the angular portion of said flange with respect to said input gap.

7. The improvement as defined in claim 6 wherein said adjusting means includes a cylindrical portion on said inductor carrier and a cylindrical mounting opening in said flange, with said flange mounted with said opening journalled on said cylindrical portion and means for locking said flange in adjusted angular positions on said cylindrical portion.

8. The improvement as defined in claim 1 wherein said inductor is a loop with an input gap and said flange portions are part of a flange and including means for adjusting the angular portion of said flange with respect to said input gap.

9. The improvement as defined in claim 8 wherein said adjusting means includes a cylindrical portion on said inductor carrier and a cylindrical mounting opening in said flange, with said flange mounted with said opening journalled on said cylindrical portion and means for locking said flange in adjusted angular positions on said cylindrical portion.

10. A floating inductor assembly for use in heating a generally conical valve seat formed concentrically around a central bore in an engine component and adapted to be moved toward and away from said valve seat by a selectively movable element, said inductor assembly comprising: a carrier, an inductor having a shape generally matching said seat and mounted on said carrier, an aligning nose member extending from said carrier in a given direction and generally concentric with said inductor, first and second flange portions supported on said carrier and extending radially outwardly in a direction perpendicular to said given direction, said flange portions each being adapted to engage a coupling member for supporting said assembly onto said movable element for radial movement only with respect to said movable element.

11. A floating inductor assembly as defined in claim 10 wherein said inductor is a loop with an input gap and said flange portions are part of a flange and including means for adjusting the angular portion of said flange with respect to said input gap.

12. A floating inductor assembly as defined in claim 11 wherein said adjusting means includes a cylindrical portion on said inductor carrier and a cylindrical mounting opening in said flange, with said flange mounted with said opening journalled on said cylindrical portion and means for locking said flange in adjusted angular positions on said cylindrical portion.

13. In an apparatus for inductively heating a generally conical valve seat formed concentrically around a central bore in an engine component, said apparatus including a selectively movable element adapted to be moved along an axis between an extended heating position and a retracted loading position and an inductor assembly, said inductor assembly including a carrier, an inductor having a shape generally matching said seat and mounted onto said carrier, an aligning nose member extending from said carrier parallel to said axis and generally concentric with said inductor, means for supporting said inductor assembly on said movable element, said mounting means including means for allowing only radial movement of said carrier with respect to said movable element when said nose member enters into said bore during movement of said element into said heating position with said inductor in heating relationship with said seat and centering means for biasing said carrier into a preselected radial position, the improvement comprising: said mounting means includes an elongated flange having flange portions extending in diametrically opposite directions from said carrier and separate means for clamping each of said flange portions onto said movable member, said clamping means each allowing only radial movement of said flange portions with respect to said movable element, said movable element having a first dimension in a first direction transverse to said opposite directions and a second dimension in a second direction generally orthogonal to said first direction and corresponding to said opposite directions, said first dimension being substantially less than said second dimension.

* * * * *